United States Patent [19]

Radaelli et al.

[11] 4,339,082

[45] Jul. 13, 1982

[54] RAPID TRANSIENT ELECTROINJECTOR

[75] Inventors: Dario Radaelli, Legnano; Walter Giraudi, Milan, both of Italy

[73] Assignee: Alfa Romeo S.p.A., Milan, Italy

[21] Appl. No.: 173,326

[22] Filed: Jul. 29, 1980

[30] Foreign Application Priority Data

Aug. 3, 1979 [IT] Italy ..... 24927 A/79

[51] Int. Cl.[3] ..... B05B 1/30

[52] U.S. Cl. ..... 239/585; 251/139

[58] Field of Search ..... 239/585; 251/132, 141, 251/139; 335/258, 262

[56] References Cited

U.S. PATENT DOCUMENTS

| | | | |
|---|---|---|---|
| 3,082,359 | 3/1963 | Mangiafico et al. | 251/141 X |
| 3,974,998 | 8/1976 | Wood | 251/141 X |
| 4,007,880 | 2/1977 | Hans et al. | 239/585 |
| 4,046,351 | 9/1977 | Lang | 335/262 |
| 4,101,074 | 7/1978 | Kiwios | 239/585 |
| 4,254,935 | 3/1981 | Jarrett | 251/139 X |

*Primary Examiner*—Robert B. Reeves
*Assistant Examiner*—Paul A. Sobel
*Attorney, Agent, or Firm*—Charles E. Brown

[57] ABSTRACT

An electromagnetically actuated fuel-injector for an internal combustion engine is disclosed, in which the core (15) of the coil (16) for the cuplike valve member (37) intended reciprocably to control the fuel-injecting nozzle (48) is provided with longitudinally arranged radial bores (35) in order to minimize the detrimental effects of eddy currents. Longitudinal slots (52) can be provided in said coil core according to an alternative embodiment.

5 Claims, 2 Drawing Figures

RAPID TRANSIENT ELECTROINJECTOR

This invention relates to an electroinjector for delivering intermittent feeds of fuel at low pressure to an Otto cycle internal combustion engine. The invention consists of improvements in the magnetic and hydraulic circuits of the electroinjector which enable the transients to be reduced, in particular the closure transients of its valve member.

Electroinjectors are known to be constituted by an outer casing, an internally guided valve member of cup form which can be raised and lowered in order to open and close the fuel injection nozzle, and further comprising a cup operating coil wound partly about its core and partly about the cup. The casing, the coil core and cup, which constitutes its armature, form the magnetic electroinjector circuit together with the variable air gap corresponding to the cup stroke, and together with the air gap of fixed thickness between the cup and casing.

The fuel under pressure is fed to the injection nozzle by a duct inside the coil core.

When these electroinjectors are used for delivering intermittent fuel feeds, their valve member is made to open cyclically during the intake stage of the relative cylinders for a period of time which varies with the fuel quantity to be injected at each cycle. Thus the metering of a constant fuel quantity is more accurate the more the time for which the valve member remains open coincides with the duration of the signal received by the coil, i.e. the shorter and more stable the opening and closure transients, represented by the delay between the response and the control signal.

The duration of the transients is influenced mainly by the dimensions and mass of the valve member, by any friction encountered by the valve member during its opening and closure strokes, and by the capacity of the coil to become energised and de-energised more or less rapidly when the control signal occurs or ceases.

Other determining factors are the configuration of the magnetic circuit with which the magnetic flux generated by the coil is linked, and the configuration of the hydraulic circuit through which the fuel passes inside the electroinjector. In the main, the magnetic circuit must have a low reluctance and minimum dispersion of the magnetic induction flux. The hydraulic circuit must not lead to pressure drop in the fuel flow passing through it, or to any back pressure by the pressurized fuel on the valve member.

Our research has shown that besides these factors, the operation of electroinjectors of the described type is influenced by other parameters, and in particular, in the case of the magnetic circuit, a factor of considerable importance is the relative size of the air gaps, i.e. the variable air gap between the coil core and the cup which constitutes its armature, and the fixed air gap between the cup and the outer casing of the electroinjector. The maximum thickness of the variable air gap depends on the stroke which the cup has to make so that, for a prechosen base section thereof, no pressure drop arises in the fuel flow upstream of the injection nozzle.

With a variable air gap dimensioned in this manner, it is found experimentally that the opening transient of the cup increases with increase in the fixed air gap thickness and thus with its reluctance, for equal areas of said fixed air gap, whereas the closure transient of the cup reduces with increased thickness and reluctance of the fixed air gap.

It has been found that the value of the fixed air gap reluctance which minimises the sum of the opening and closure transients is substantially equal to the reluctance of the variable air gap corresponding to the maximum cup stroke.

It is therefore possible to raise the cup until it abuts against the core, and avoid the use of baffles of non-ferromagnetic material, because the magnetic adhesion effect between the two is decidedly reduced.

In order to improve the magnetic circuit of the electroinjector, a core has been used for the coil which is provided with longitudinal groups of radial bores, the purpose of which is to minimise the effect of the parasite currents dependent on the variation in the magnetic induction flux, thus reducing their effect on the transient behaviour of the electroinjector.

Our research has also shown that with regard to the hydraulic circuit of the electroinjector it is advantageous to provide fuel passage ports in its internal guide in proximity to the variable air gap between the cup and coil core, in order to facilitate fuel flow inside said air gap and prevent hydraulic adhesion due to a suction effect between the cup and core. This provision accelerates the lowering of the cup, and prevents errors in the metering of the fuel which would arise with closure transients which were not sufficiently rapid. We have also encountered improvements in the opening and closure transients by disposing a number of bleed ports in the cup for the fuel which is inside it, and which would otherwise undergo sudden variations in positive and negative pressure by the pumping effect due to the cyclic raising and lowering of the cup.

The electroinjector according to the invention is constituted by an outer casing, a feed duct for the pressurised fuel, at least one injection nozzle, a valve member for said nozzle, and an operating coil provided with a core in the form of the ferromagnetic hollow cylinder, said coil being arranged to cyclically control the opening of said valve member by the effect of suitable control signals, said feed duct for the pressurised fuel being disposed inside said core, said valve member, which constitutes the coil armature, being in the form of a cup with its lateral wall of ferromagnetic material and its base wall of a material suitable for the fuel seal, inside the cup there being disposed resilient means able to keep said base wall in contact with the injection nozzle, said cup being slidably supported by a guide sleeve inserted into said core, said coil being wound on a spool inside which said coil core and said cup are partly inserted and aligned in an axial direction, between the core and cup there being present a first annular air gap which corresponds to the cup stroke and is therefore variable, between the lateral wall of the cup and the outer casing there being present a second annular air gap of fixed thickness, wherein in the electroinjector said first air gap and said second air gap have a reluctance of approximately equal value when the first air gap corresponds to the maximum stroke of said cup.

In the electroinjector according to the invention, said coil core is provided with longitudinal groups or radial bores, or longitudinal slots.

Further in the electroinjector according to the invention, said guide sleeve is provided with radial bores disposed in proximity to said first annular air gap.

Finally, in the electroinjector according to the invention, the lateral wall of said cup is provided with bleed ports for the fuel.

The characteristics and advantages of the invention will be more apparent from FIGS. 1 and 2 which show a preferred embodiment of the invention by way of non-limiting example, and in which.

Figure 1:
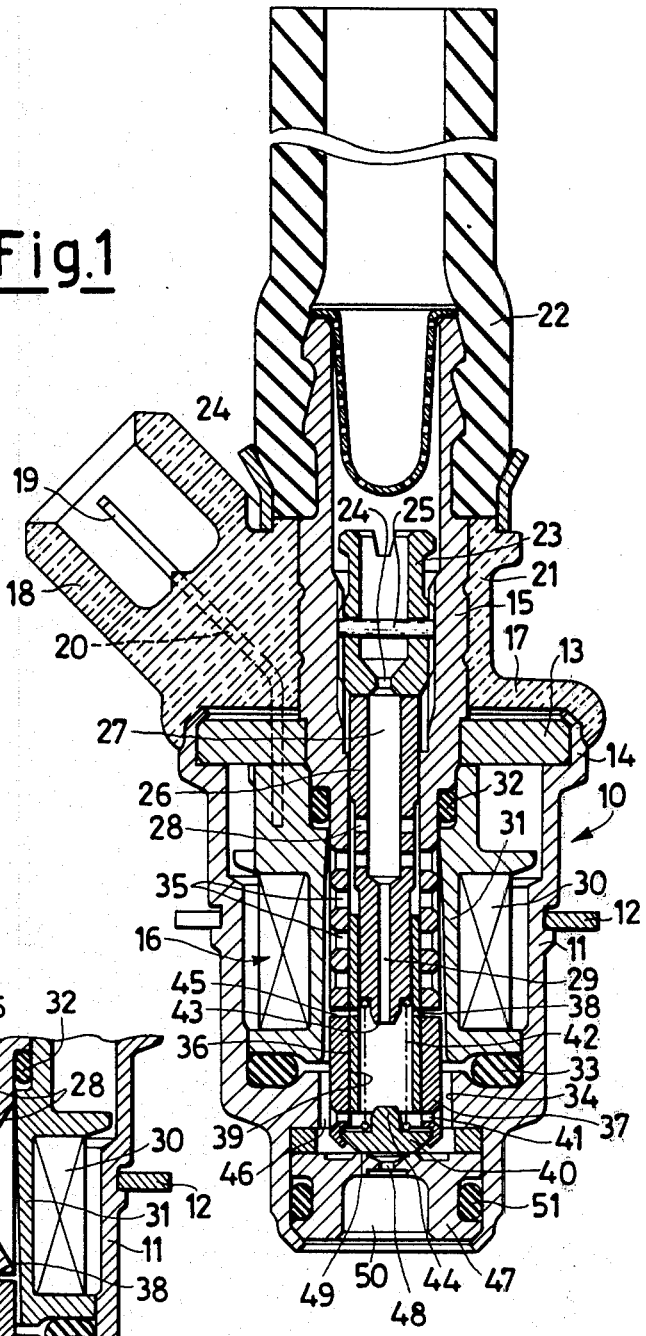
FIG. 1 is a section on a longitudinal plane through the injector according to the invention.

The electroinjector shown is indicated overall by 10, and is provided with a cylindrical casing 11 which is fixed by the flange 12 to the engine heat at a cylinder intake duct (not shown because of known type). The casing 11 is closed upperly by the annular wall 13, which is fixed in a suitable seat 14 by clinching the edge of the casing. The hollow cylindrical member 15 which constitutes the core of the electroinjector operating coil, indicated overall by 16, is inserted into the aperture in the annular wall 13. The core 15 is constructed of ferromagnetic material.

A cover 17 of insulating material is mounted on the upper wall of the casing 11, and is provided with the connector 18 into which projects the contact strip 19 for feeding current to the coil 16. The contact strip 19 is inserted into a suitable duct 20 provided in the cover 17. The cover 17 is also provided with the connector 21, which is mounted on the core 15 and is connected to the sleeve 22 which feeds pressurised petrol to the electroinjector, and is also mounted on the core 15.

The bush 23 is screwed into the core 15, and its base wall comprises the calibrated port 24 for metering the fuel reaching the electroinjector. The bush 23 is provided with a pin 25 to prevent it withdrawing in the presence of vibration.

A tube 26 is also inserted into the core 15, and is provided in its upper part with a fuel distribution channel 27, and with radial bores 28 for conveying the fuel to the core 15. The tube 26 is provided in its lower part with an axial channel 29 for conveying the fuel into the cup 37, which as explained hereinafter constitutes the valve element of the electroinjector.

The coil 16 has its winding 30, supported by the spool 31, inserted between the member 15 constituting its core and the casing 11. A seal ring 32 is disposed between the spool 31 and core 15, and a further seal ring 32 is disposed between the spool 31 and the inner annular expansion 34 of the casing 11.

Longitudinal groups of radial bores indicated by 35 are provided in the wall of the core 15, in the zone adjacent to the coil spool 31, their purpose being to cut the parasite currents linked with the magnetic induction flux through the core, and to enable fuel to pass in order to cool the coil.

A sleeve indicated by 36 is inserted into the lower end of the core 15 in order to centre the cup, indicated overall by 37, and to act as a slide guide therefor. Radial bores 38 are provided in the sleeve 36 for conveying the fuel to the outside.

The cup 37 is constituted by a lateral wall 39 of a material permeable to the magnetic induction flux, and a base wall 40 of a material suitable for the hydraulic seal, for example Delrin. Bores 41 are provided in the lateral wall 39 of the cup 37 for conveying the fuel to the outside.

A return spring 42 is disposed between the base wall 40 of the cup 37 and the base wall of the tube 26, these walls being provided with projections 43 and 44 respectively, for centering the spring.

The variable air gap between the cup 37 and core 15 is indicated by 45. The maximum thickness of this air gap corresponds to the stroke of the cup. The air gap of fixed thickness between the cup 37 and annular expansion 34 of the casing 11 is indicated by 46.

A block 47 is inserted into the lower reduced diameter portion of the casing 11, and is fixed by clinching the casing edge. The injection nozzle 48 is formed in the wall of the block 47, which is also provided with an annular projection 49 to ensure that the base wall 40 of the cup 37 seals against the nozzle. A chamber 50, into which the nozzle 48 injects the fuel, is also provided in the wall of the block 47. A seal ring 51 is disposed between the block 47 and casing 11.

Figure 2:
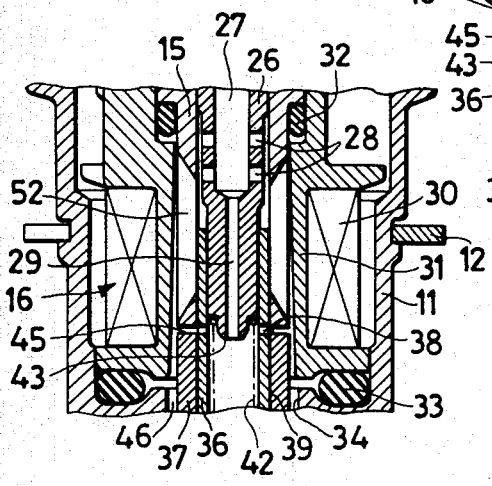
FIG. 2 shows a modification of a component of the electroinjector of FIG. 1.

FIG. 2 shows the core 15 of an electroinjector such as that of FIG. 1.

In this case, the longitudinal groups of radial bores 35 are replaced by longitudinal slots indicated by 52.

The signal for controlling the delivery of the described electroinjector reaches the coil 16 cyclically, in the form of a current supply, from an engine injection control system, not shown because it can be of any known type.

The current pulses, the duration of which varies with the petrol quantity required by the engine under the various operating conditions, energise the coil which generates a magnetomotive force in the magnetic circuit constituted by the cylindrical wall of the casing 11, the air gap 46, the lateral wall 39 of the cup 37, the air gap 45, the core 15 and the annular wall 13.

due to the effect of the magnetomotive force, said magnetic circuit generates a magnetic induction flux which causes the cup 37 to lift against the action of the spring 42, until it abuts against the core 15. A fuel quantity which depends on the time of opening of the cup 37 is injected by the nozzle 48.

When the current pulse ceases, the cup 37 is caused by the return spring 42 to fall so as to re-close the injection nozzle 48.

The described electroinjector is characterised by very rapid opening and closure transients, and thus the metering of the injected fuel is very accurate, by virtue of the fact that certain original improvements have been introduced into its magnetic and hydraulic circuits which have enabled both the opening transient and closure transient to be improved. In this respect, the sum of the opening and closure transients has been minimised by modifying the magnetic circuit of the electroinjector by making the reluctance of the air gap 46 substantially equal to the reluctance of the air gap 45 when the thickness of this latter corresponds to the maximum stroke of the cup, and by providing the longitudinal groups of radial bores 35 or longitudinal slots 52 in the core 15.

The improvement in the opening and closure transients has also been obtained by modifying the hydraulic circuit by providing the bores 38 in the sleeve 36 at the air gap 45 in order to facilitate fuel flow into said air gap at the instant when the cup 37 is separated from the core 15, and by providing the bleed bores 41 in the lateral wall 39 of the cup 37 in order to prevent any sudden pressure variation in the fuel contained within it.

We claim:

1. An electroinjector for delivering intermittent feeds of fuel at low pressure to an internal combustion engine of the Otto cycle, the electroinjector comprising an outer casing, a feed duct for the low pressure fuel, at least one injection nozzle, a valve member for said nozzle, and an operating coil provided with a core in the form of a ferromagnetic hollow cylinder, said coil being arranged to cylically control the opening of said valve member by the effect of suitable control signals, said feed duct for the pressurised fuel being disposed inside said core, said valve member forming the coil armature and being in the form of a cup having a lateral wall of ferromagnetic material and a base wall of a material suitable for sealing the low pressure fuel, resilient means within said cup and urging said base wall into contact with the injection nozzle, a guide sleeve within said core and projecting into said cup, said cup being slidably supported by said guide sleeve, said coil being wound on a spool inside which said coil core and said cup are partly received and aligned in an axial direction, between the core and cup there being present a first annular air gap which corresponds to the cup stroke and is therefore variable, between the lateral wall of the cup and an outer casing there being present a second annular air gap of fixed thickness, wherein in the electroinjector said first air gap and said second air gap have a reluctance of substantially equal value when the first air gap corresponds to the maximum stroke of said cup.

2. An electroinjector as claimed in claim 1, wherein said coil core is provided with longitudinal groups of radial bores.

3. An electroinjector as claimed in claim 1, wherein said coil core is provided with longitudinal slots.

4. An electroinjector as claimed in claim 1, wherein said guide sleeve is provided with radial bores disposed in proximity to said first annular air gap.

5. An electroinjector as claimed in claim 1, wherein said cup is provided with bleed ports for the fuel.

* * * * *